US007645162B2

(12) United States Patent
Kadar-Kallen et al.

(10) Patent No.: US 7,645,162 B2
(45) Date of Patent: Jan. 12, 2010

(54) CONNECTOR ASSEMBLY HAVING A SLIDER ELEMENT

(75) Inventors: Michael Aaron Kadar-Kallen, Harrisburg, PA (US); Edmund J. Haley, Dillsburg, PA (US); Larry Gene Eby, Dover, PA (US)

(73) Assignee: Tyco Electronics Corporation, Middletown, PA (US)

( * ) Notice: Subject to any disclaimer, the term of this patent is extended or adjusted under 35 U.S.C. 154(b) by 44 days.

(21) Appl. No.: 12/019,392

(22) Filed: Jan. 24, 2008

(65) Prior Publication Data

US 2009/0191750 A1 Jul. 30, 2009

(51) Int. Cl.
*H01R 9/05* (2006.01)

(52) U.S. Cl. ..... 439/578

(58) Field of Classification Search ..... 439/320, 439/344, 354, 310, 578, 246–248, 676
See application file for complete search history.

(56) References Cited

U.S. PATENT DOCUMENTS 3,111,355 A * 11/1963 Samburoff et al. ..... 439/159
4,789,351 A * 12/1988 Fisher et al. ..... 439/248
5,035,640 A * 7/1991 Drogo ..... 439/321
5,558,532 A * 9/1996 Hopper ..... 439/310
5,674,086 A * 10/1997 Hashizawa et al. ..... 439/310
7,124,505 B2 * 10/2006 Friesen et al. ..... 29/876
7,485,003 B2 * 2/2009 Mandrusov et al. .... 439/607.41
7,527,512 B2 * 5/2009 Montena ..... 439/265
2004/0219834 A1 * 11/2004 Vielhaber et al. ..... 439/585

* cited by examiner

*Primary Examiner*—Renee Luebke
*Assistant Examiner*—Larisa Tsukerman

(57) ABSTRACT

A connector assembly is provided that has a plug end and a cable end and is configured to insert a plug that is coupled to a cable into a receiving module of an electrical device. The connector assembly includes an inner body that has a cable channel extending in an axial direction between the plug end and the cable end. The connector assembly also includes a slider element that is configured to hold a plug proximate to the plug end. The slider element is held by and movable along the inner body in an axial direction. The connector assembly further includes an outer housing that surrounds the inner body and the slider element. The outer housing is movable in the axial direction with respect to the inner body and the slider element, and the outer housing is also configured to attach to the electrical device.

20 Claims, 13 Drawing Sheets

CONNECTOR ASSEMBLY HAVING A SLIDER ELEMENT

BACKGROUND OF THE INVENTION

The invention relates generally to connector assemblies, and more particularly to connector assemblies that form an environmental seal around an electrical or fiber optic connection.

As electrical and communication devices or systems age, components of the device or system may need to be replaced or serviced. For example, some conventional electrical devices, including optoelectronic devices, use small form-factor pluggable (SFP) transceivers for both telecommunication and data communication applications. In time, the SFP transceiver may need to be replaced or serviced due to poor performance or a change/upgrade in technology. Generally, the SFP transceiver interfaces a circuit board to one or more connectors, such as an LC connector. The standard LC connector has a plug body that includes a coupling mechanism (e.g., a depressible latch) to prevent unintentional removal of the LC connector from the SFP transceiver.

In one conventional connector assembly, an LC connector is inserted into an SFP transceiver of an electrical control box. The connector assembly includes an outer housing that surrounds the connecting SFP transceiver and LC connector. The outer housing screws onto a fitting of the box in order to form a seal around the connection. The coupling mechanism in the conventional connector assembly is a latch that is permanently depressed so that the LC connector may freely be inserted and withdrawn from the SFP transceiver. However, in order to maintain the communicative connection between the SFP transceiver and the LC connector while the latch is depressed, an insertion force must be continuously applied by the connector assembly. Over time, the continuous insertion force may damage the SFP transceiver, the mounting hardware, or other inner circuitry of the control box.

Thus, there is a need in the industry for electrical and/or fiber optic connector assemblies that facilitate connecting and disconnecting a plug body with a receiving module without continuously applying an axial force into the receiving module. Further, there is a need in the industry for connector assemblies that utilize the coupling mechanism on the plug body.

BRIEF DESCRIPTION OF THE INVENTION

In one embodiment, a connector assembly is provided. The connector assembly has a plug end and a cable end and is configured to insert a plug into a receptacle assembly. The connector assembly includes an inner body that has a cable channel extending in an axial direction between the plug end and the cable end. The connector assembly also includes a slider element that is configured to hold a plug from a cable proximate to the plug end. The slider element is held by and movable along the inner body in an axial direction. The connector assembly further includes an outer housing that surrounds at least a portion of the inner body and the slider element. The outer housing is movable in the axial direction with respect to the inner body and the slider element, and the outer housing is also configured to attach to the electrical device.

Optionally, the inner body has a body surface and the slider element also includes a frictional member. The frictional member may be in slidable contact with the body surface as the slider element moves in the axial direction.

In another embodiment, a connector system having a plug end and a cable end is provided. The connector system is configured to insert a plug coupled to a cable into a receiving module of an electrical device. The connector system includes a guideframe having a base positioned proximate to the receiving module. The connector system also includes a connector assembly that is configured to engage the guideframe. The connector assembly includes an inner body having a cable channel extending in an axial direction between the plug end and the cable end. The connector assembly also includes a slider element that is configured to hold the plug proximate to the plug end, wherein the slider element is held by and movable along the inner body in an axial direction. Further, the connector assembly includes an outer housing that surrounds at least a portion of the inner body and the slider element. The outer housing is configured to attach to the electrical device.

DETAILED DESCRIPTION OF THE INVENTION

Figure 1:
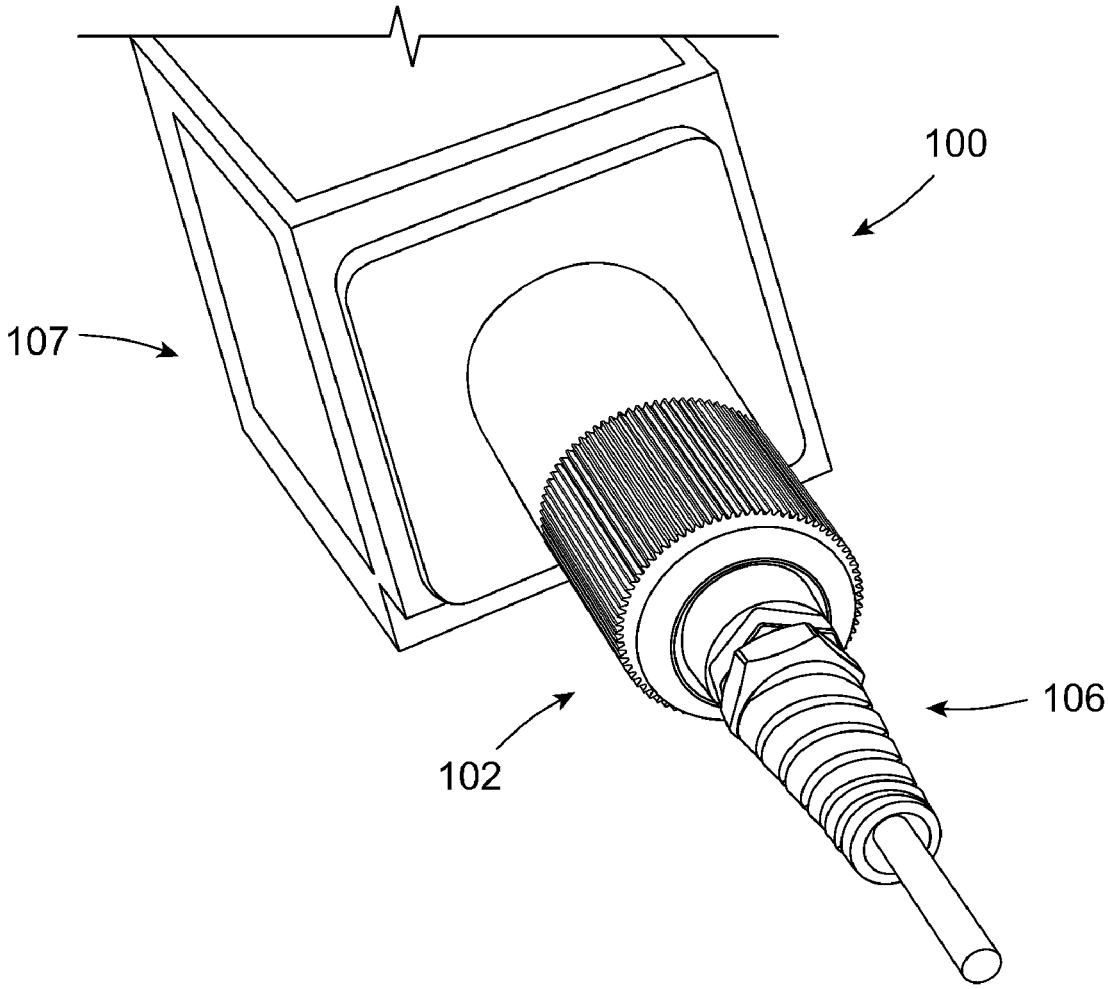
FIG. 1 is a perspective view of a connector system formed in accordance with one embodiment.

FIG. 1 is a perspective view of a connector system 100 formed in accordance with one embodiment. The connector system 100 is used to connect a cable assembly 106 to an electrical device or system 107 and includes a connector assembly 102 and a guideframe 104 (shown in FIG. 3). The electrical device 107 may be, for example, an optoelectronic device or fiber optic adapter or connector. In FIG. 1, the connector assembly 102 is fully mated with the guideframe 104 such that the connector assembly 102 is secured to a wall or surface of the electrical device 107. When fully mated, the connector assembly 102 may form an environmental seal around an electrical and/or fiber optic connection between the electrical device 107 and cable assembly 106. As will be discussed in greater detail below, the connector system 100 facilitates connecting and disconnecting a plug 114 (FIG. 2) to a receiving module 202 (FIG. 4) of the electrical device 107. As one example, the plug 114 may be a duplex LC connector and the receiving module 202 may be a SFP transceiver or fiber optic adapter. However, the connector system 100 is not limited as such and may be used to facilitate connecting and disconnecting other electrical or optical components.

Figure 2:
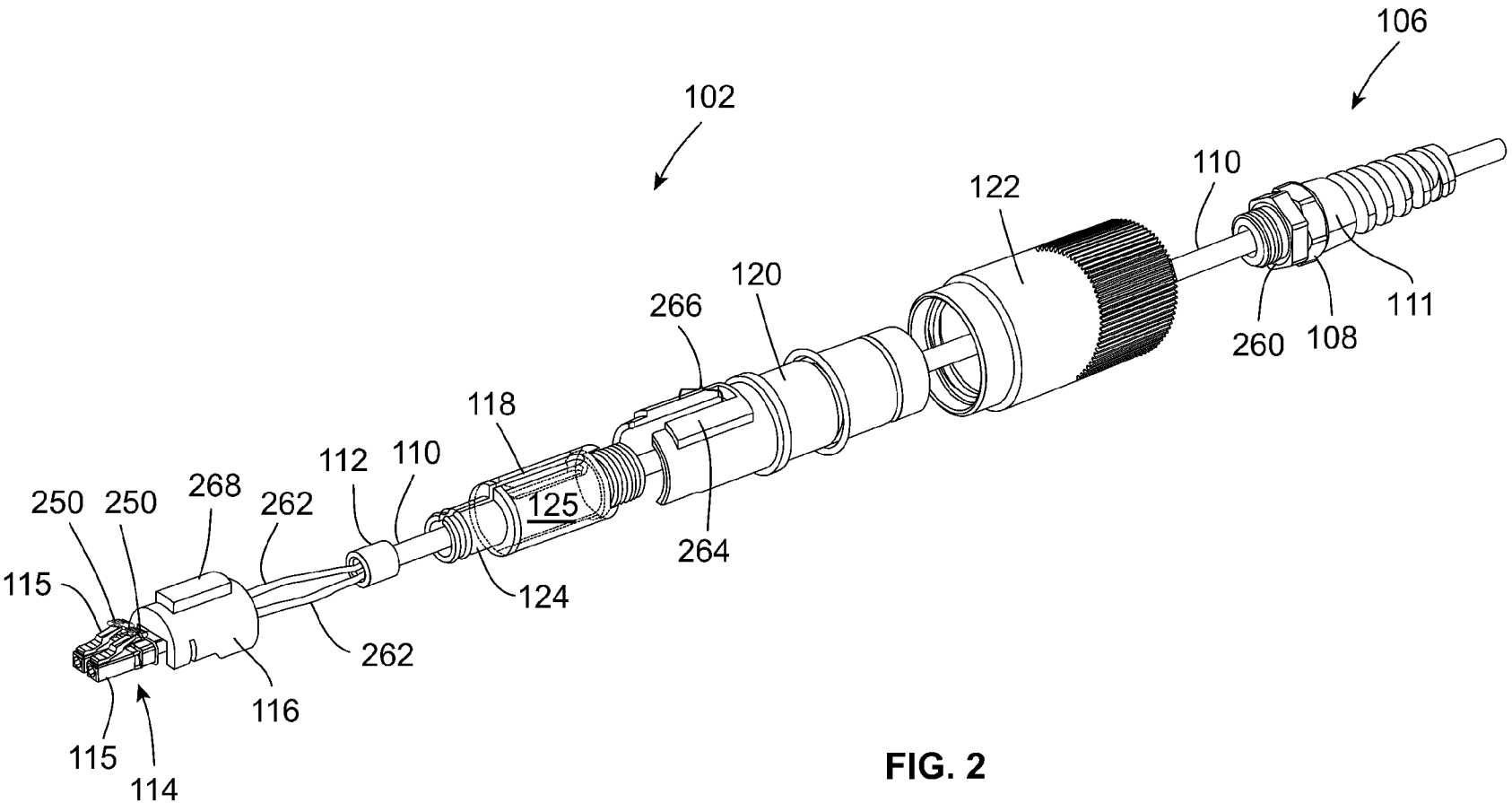
FIG. 2 is an exploded view of a connector assembly that may be used with the system shown in FIG. 1.

FIG. 2 is an exploded view of the connector assembly 102 and illustrates parts and components of the connector assembly 102 before the connector assembly 102 is assembled about the cable assembly 106. The cable assembly 106 includes a cable fitting 108 and a cable jacket 110 that extends through the cable fitting 108 along an axial direction. The cable fitting 108 includes threads and a sealing member 260 at the base of the threads on one side of the cable fitting 108. The cable fitting 108 also includes on the opposite side a cable seal gasket 109 (shown in FIG. 10). The cable seal gasket 109 is compressed, sealing the cable fitting 108 to the cable jacket 110 when the strain relief 111 is rotated counterclockwise with respect to the cable fitting 108. The cable assembly 106 also includes a crimp sleeve 112 located at a terminal end of the cable jacket 110. Cable conductors 262, such as electrical wire or optical fibers, extend outward from the crimp sleeve 112 and join the plug 114. The plug 114 may include one or more plug bodies 115 having a coupling mechanism 250 that is used to removably attach the plug 114 to the receiving module 202 (FIG. 4) when the plug 114 are inserted. The coupling mechanism 250 can be, for example, a flexible latch that may be depressed in order to disengage each plug body 115 from the receiving module 202. In FIG. 2, the plug bodies 115 are a pair of LC connectors, but other cables and plug assemblies may be used.

The connector assembly 102 includes a slider element 116 that is configured to hold the plug 114, an inner body 118, an intermediate housing 120, and an outer housing 122. The inner body 118 includes a body surface 125 and a shaft 124 that projects outward along an axial direction. When constructing the connector assembly 102, the slider element 116 is slidably engaged to the shaft 124 and the inner body 118 is secured to the intermediate housing 120 such that intermediate housing 120 surrounds at least a portion of the inner body 118. The cable conductors 262 extend through the inner body 18 and slider element 116 to the plug bodies 115. The intermediate housing 120 may include a key member 264 projecting from an outer surface of the intermediate housing 120 and a key slot 266 extending from an edge of the intermediate housing 120 into the key member 264. The slider element 116 may also have a key member 268 that is configured to mate with the key slot 266 of the intermediate housing 120. As will be discussed in greater detail below, the key members 268 and 264 and the key slot 266 facilitate directing the plug 114 into the receiving module 202.

Figure 4:
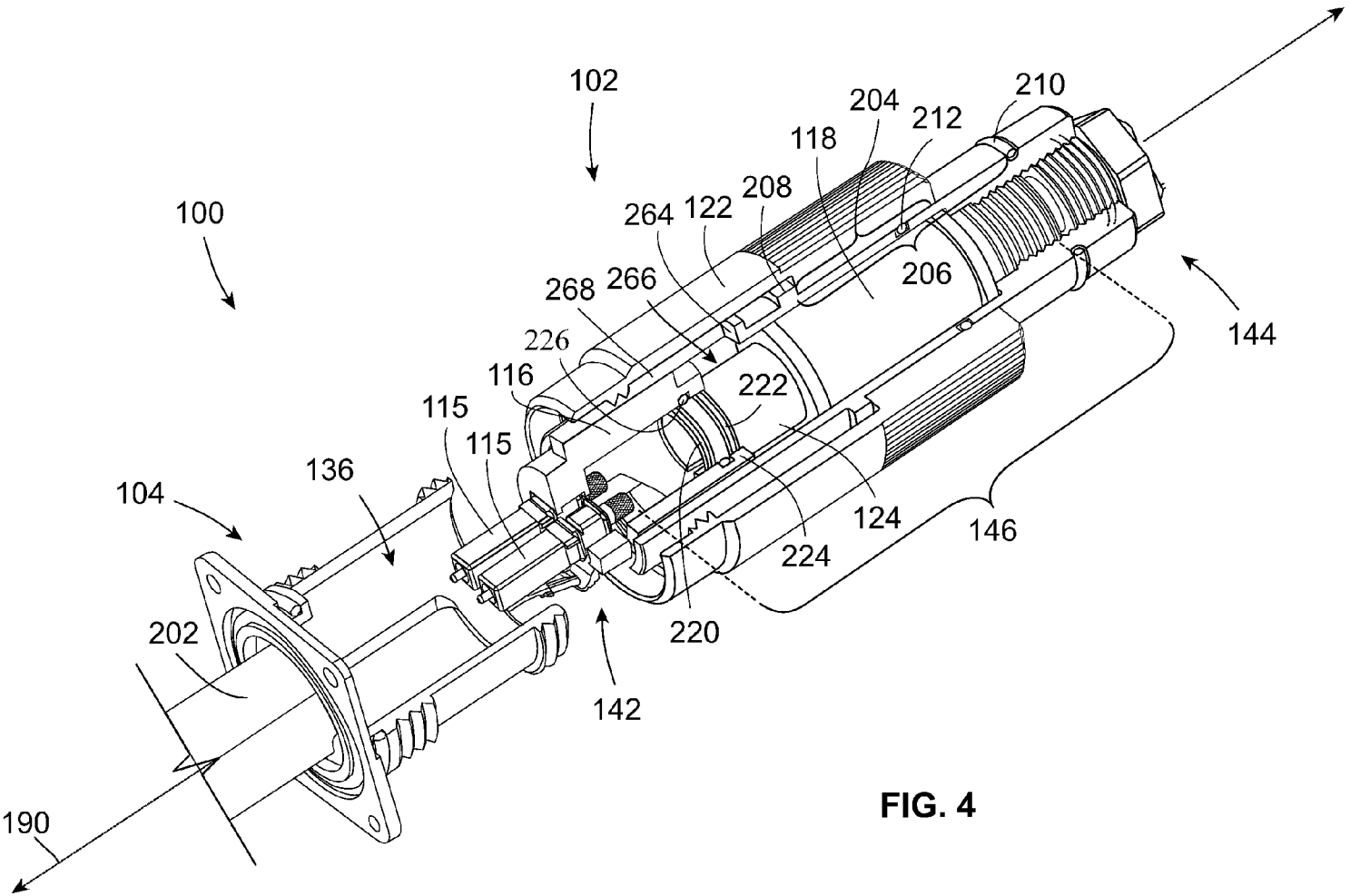
FIG. 4 is an exposed perspective view of the connector assembly in FIG. 1 before the connector assembly engages the guideframe.

The outer housing 122 is fitted over the intermediate housing 120 such that the outer housing 122 may slide and/or rotate about an outer surface of the intermediate housing 120. When the connector assembly 102 is fully constructed, the outer housing 122 may be movable with respect to the intermediate housing 120 and the inner body 118, and the slider element 116 may be movable with respect to the inner body 118 and the outer housing 122. As will be discussed in greater detail below, the connector assembly 102 may be moved or adjusted into various positions. As such, the connector assembly 102 may facilitate connecting and disconnecting the plug 114 with the receiving module 202 (FIG. 4). Furthermore, when the plug 114 is engaged with the receiving module 202, the connection between the plug 114 and the receiving module 202 is maintained by the coupling mechanism(s) 250 without substantial additional forces directing or forcing the plug 114 into the receiving module 202. As such, the connector assembly 102 may improve the efficiency and lifetime operation of the receiving module 202 or other hardware or circuitry of the electrical device 107 (FIG. 1), unlike other connector assemblies that provide substantial axial force to maintain the connection between the plug and the receiving module.

Figure 3:
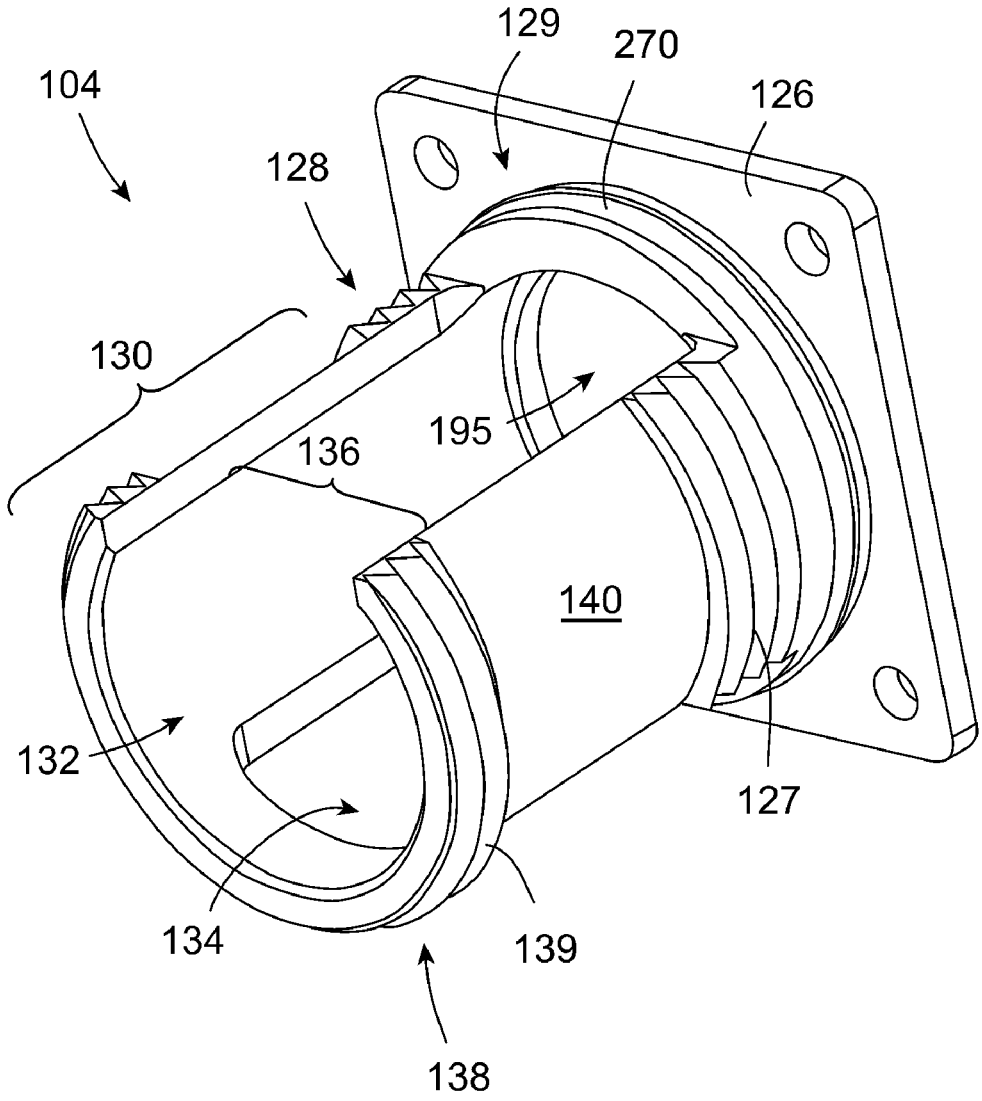
FIG. 3 is a perspective view of a guideframe that may be used with the system shown in FIG. 1.

FIG. 3 is a perspective view of a guideframe 104 that may engage the connector assembly 102 (FIG. 2) to form the connector system 100 (FIG. 1). The guideframe 104 may include a panel 126 having an opening 195 and a base 128 projecting from a surface of the panel 126. The panel 126 may be secured or attached to a wall (not shown) of the electrical device 107 (FIG. 1) such that an aperture (not shown) within the wall is aligned with the opening 195. In an alternative embodiment, the guideframe 104 may be integratively formed with the wall of the electrical device 107. The base 128 may include an annular portion 129 and a fastener element 127 extending from the annular portion 129. The annular portion may hold a sealing member 270. The base 128 may be configured to engage the outer housing 122 (FIG. 2) to form a seal around the plug 114 (FIG. 2) and receiving module 202 (FIG. 4). For example, the base 128 may directly surround the opening 195 (e.g., like a collar). In FIG. 3, the fastener element 127 is one or more threads projecting from a surface of the base 128 so that corresponding threads on the outer housing 122 may engage. However, the fastener element 127 may have other features to facilitate attaching the outer housing 122 to the base 128. For example, a stem wall 130 may include indentations that mate or snap-fit with protrusions of the outer housing 122. As another example, the outer housing 122 may be formed from a flexible material that flexes around and grips a single ridge projecting from the stem wall 130. Other fastening methods, such as using clips, snaps, ties, bolts, screws and the like, may be used to attach the outer housing 122 to the base 128, to the panel 126, or to the electrical device 107.

The guideframe 104 may include the stem wall 130 projecting away from the base 128 and forming a pathway 132 that extends to the opening 195. As will be discussed in greater detail below, the stem wall 130 and the pathway 132 may be shaped to mate with the connector assembly 102 (FIG. 2) when the connector assembly 102 is coupled to the guideframe 104. The stem wall 130 and pathway 132 may also be configured to guide the plug 114 (FIG. 2) toward the receiving module 202 (FIG. 4) when the inner body 118 (FIG. 2) and the intermediate housing 120 (FIG. 2) are advanced through the guideframe 104. As shown in FIG. 3, the stem wall 130 has cut-outs 134 and 136. The cut-outs 134 and 136 may be configured to allow access to the pathway 132 and/or to provide visibility for a user or technician when the connector assembly 102 is partially engaged with the guideframe 104. The cut-out 134 may extend from the base 128 a predetermined distance toward an edge of the stem wall 130. In one embodiment, the cut-out 136 extends from the base 128 to the edge of the stem wall 130 and is configured to mate with key member 264 (FIG. 2) when the intermediate housing 120 engages the guideframe 104.

Also shown in FIG. 3, an end portion 138 is formed at the distal end of the stem wall 130. The end portion 138 may have a fastener element 139, such as threads or other features like those discussed with reference to fastener element 127. The end portion 138 is configured to provide sufficient support to the connector assembly 102 when the connector assembly 102 initially engages the stem wall 130 or when the connector assembly 102 is withdrawing from the stem wall 130. In FIG. 3, the end portion 138 is arc-shaped, however, other shapes including a full circle and shapes that are not circular may be used. The stem wall 130 also includes an outer surface 140 that separates the fastener elements 139 and 127 by a predetermined distance. As will be discussed in greater detail below, the separate fastener elements 139 and 127 along with the outer surface 140 facilitate guiding and supporting the connector assembly 102 when the connector assembly 102 is mated with the guideframe 104.

Figure 5:
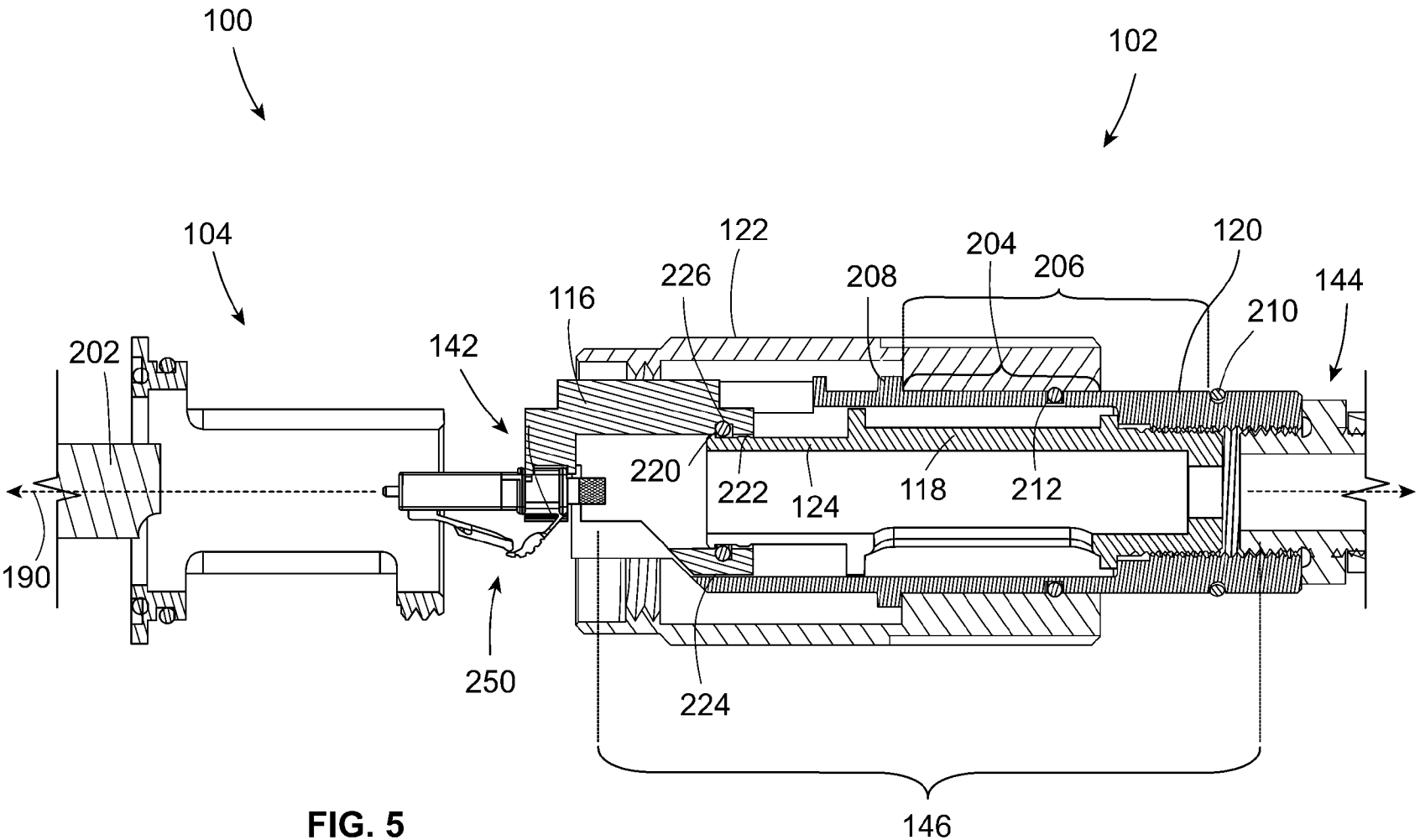
FIG. 5 is a cross-sectional view of the connector assembly shown in FIG. 4.

FIGS. 4 and 5 illustrate an exposed perspective view and a cross-sectional view, respectively, of the connector system 100 before the connector assembly 102 engages the guideframe 104. (In FIGS. 4, 6, 8, 11, and 12 a portion of the guideframe 104 and the connector assembly 102 have been removed for illustrative purposes.) The connector assembly 102 has a plug end 142 and a cable end 144 and a cable channel 146 extending therebetween. In FIGS. 4 and 5, the connector system 100 is in an initial unmated position such that the connector assembly 102 and the guideframe 104 are disconnected but aligned along a central axis 190. The outer housing 122 is coupled to and surrounds the intermediate housing 120. The outer housing 122 includes a grip portion 204 that may directly engage an outer surface of the intermediate housing 120 at a grip region 206. In particular, the grip portion 204 may be configured to slide in the axial direction and/or rotate about the central axis 190 along the grip region 206. The grip region 206 is defined between a front stop 208 and a rear stop 210. The front and rear stops 208 and 210 may be integratively formed from the intermediate housing 120 or may be a separate component, for example, a clip secured to the outer surface of the intermediate housing 122 and positioned to prevent the outer housing 122 from moving beyond a predetermined point. As shown in FIGS. 4 and 5, the outer housing 122 is in an advanced position with respect to the grip region 206 such that the grip portion 204 abuts the front stop 208. Also shown, the intermediate housing 120 may include a sealing member 212. Furthermore, the sealing member 212 may cause a frictional force against the outer housing 122 to reduce the likelihood of the outer housing 122 unintentionally sliding or rotating within the grip region 206.

Figure 6:
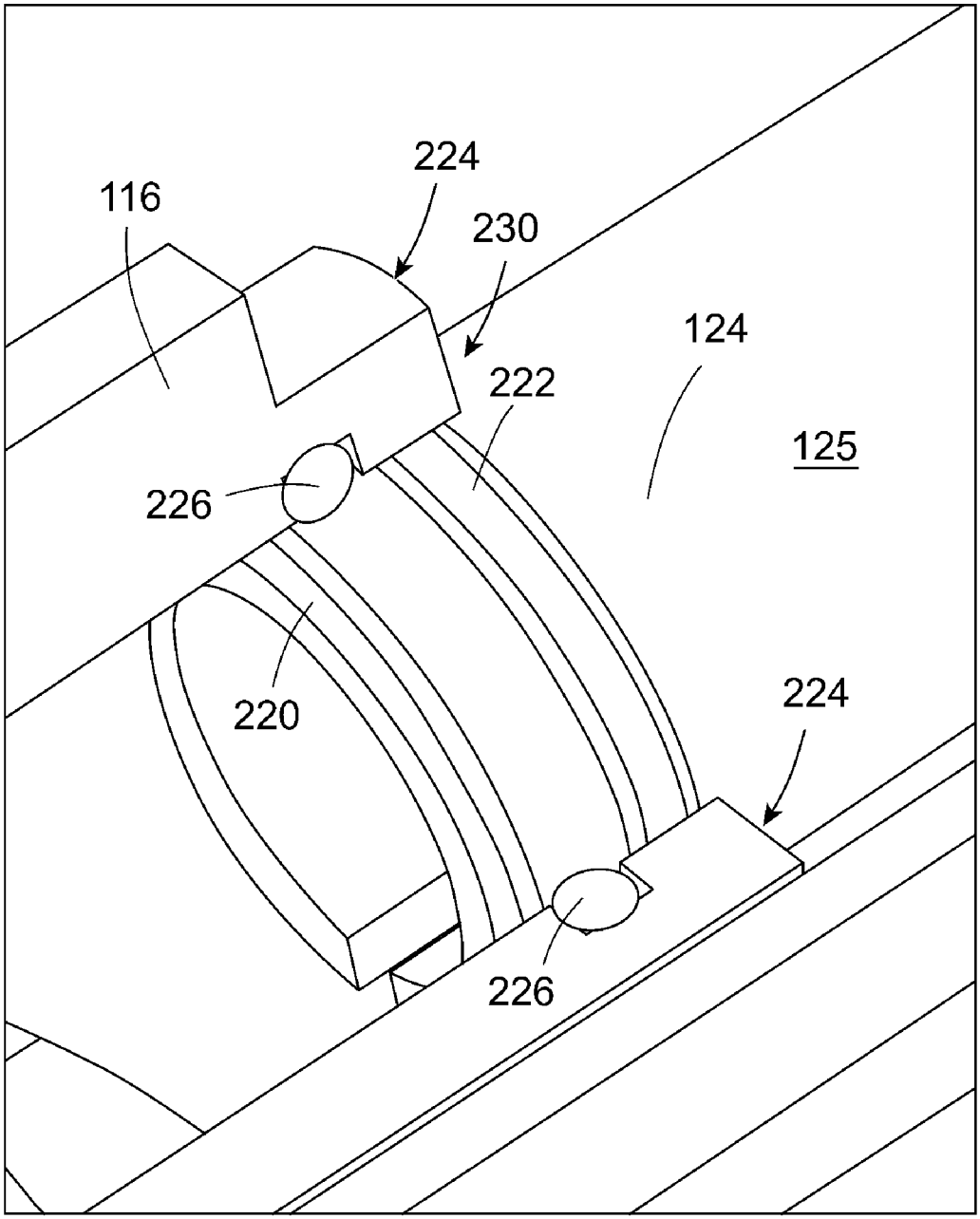
FIG. 6 is an enlarged perspective view of a holding mechanism used with the system shown in FIG. 1.

In FIGS. 4-6, the slider element 116 is in an extended position held by the inner body 118 (FIGS. 4 and 5) at a distal end of the shaft 124. The slider element 116 includes an end portion 224 shaped and configured to substantially surround and move slidably along the body surface 125 (FIG. 6). In one embodiment, the end portion 224 completely encircles the shaft 124. The shaft 124 is configured to hold the slider element 116 and may include a lip 220 and a ridge 222 that each project from the body surface 125 and are positioned a predetermined distance apart. The lip 220 is configured to stop the slider element 116 from moving beyond a predetermined point on the body surface 125, and the ridge 222 is configured to resist movement of the slider element 116. The end portion 224 may include a frictional member 226 that circumscribes and projects from the inner surface of the end portion 224. In one embodiment, the frictional member 226 rests between the lip 220 and the ridge 222 when the slider element 116 is in the extended position. The frictional member 226 may be, for example, an O-ring, elastic loop, plastic ring, band, or the like.

FIG. 6 illustrates an enlarged and exposed perspective view of the slider element 116 and the shaft 124 when the slider element 116 is in the extended position. The end portion 224 and the frictional member 226 may cooperate with the lip 220 and the ridge 222 in forming a holding mechanism 230. The holding mechanism 230 facilitates holding the slider element 116 at the distal end of the shaft 124 between the lip 220 and the ridge 222 when the slider element is in the extended position. In an alternative embodiment, the inner body 118 (FIGS. 4 and 5) or the shaft 124 includes the frictional member 226 projecting from the body surface 125 near a distal end. The slider element 116 may then include the lip 220 and the ridge 222 projecting from the inner surface of the slider element 116.

Figure 7:
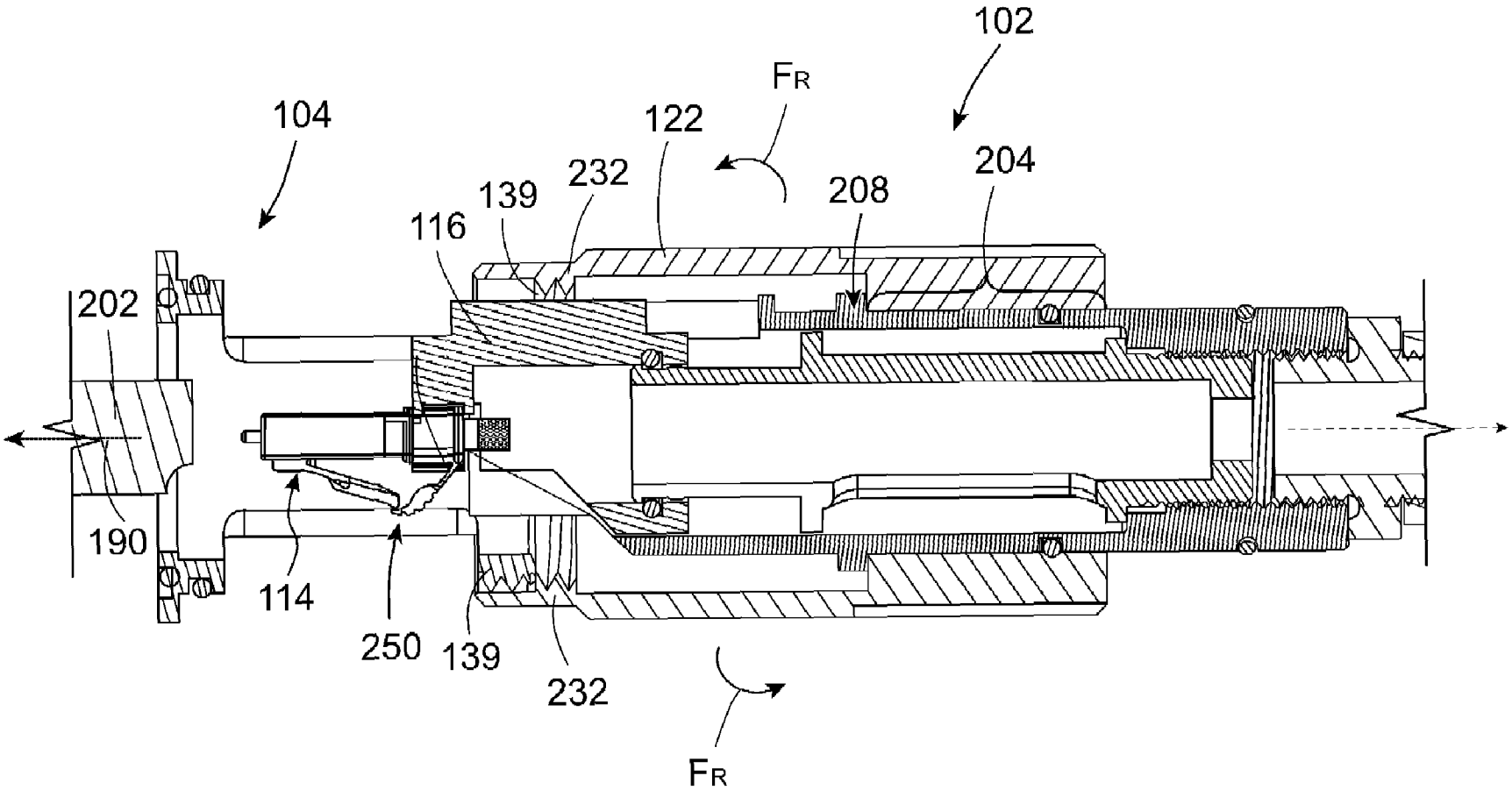
FIG. 7 is a cross-sectional view of the system in FIG. 1 as the system is being connected.

FIG. 7 is a cross-sectional view of the connector assembly 102 as the connector assembly 102 engages the guideframe 104. When inserting or removing the connector assembly 102 from the guideframe 104, the connector assembly 102, the guideframe 104, and the receiving module 202 are aligned with respect to each other along the central axis 190. To engage the guideframe 104 and the connector assembly 102, the connector assembly 102 is advanced toward the guideframe 104 in an axial direction such that the plug 114 and slider element 116 enter the pathway 132 (FIG. 3). As shown in FIG. 7, the outer housing 122 may include a fastener element 232 that is configured to engage the fastener element 139 of the guideframe 104. In FIG. 7, the fastener elements 139 and 232 are complementary threads, however other mechanisms may be used for attaching the connector assembly 102 to the guideframe 104 as discussed above. When the fastener element 232 and 139 are initially engaged, a rotational force $F_R$ in a clockwise direction may be applied to secure the fastener elements 232 and 139. While the outer housing 122 is rotated about the central axis 190, the grip portion 204 may remain in the advanced position pressed against the front stop 208. Likewise, the slider element 116 is in the extended position held by the holding mechanism 230.

Returning to FIG. 4, in one embodiment, the connector assembly 102 may include features to ensure that the plug bodies 115 are properly aligned as the plug bodies 115 advance through the pathway 132 (FIG. 3). In one embodiment, the connector assembly 102 may advance into and mate with the guideframe 104 only if the key member 264 (FIG. 2) of the intermediate housing 120 is aligned with the cut-out 136. Likewise, the key member 268 of the slider element 116 is configured to mate and be movable within the key slot 266 of the intermediate housing 120. As such, when the key member 264 is aligned with the cut-out 136 and the key member 268 is within the key slot 266, the plug bodies 115 held by the slider element 116 are properly aligned to be inserted into the receiving module 202.

Figure 8:
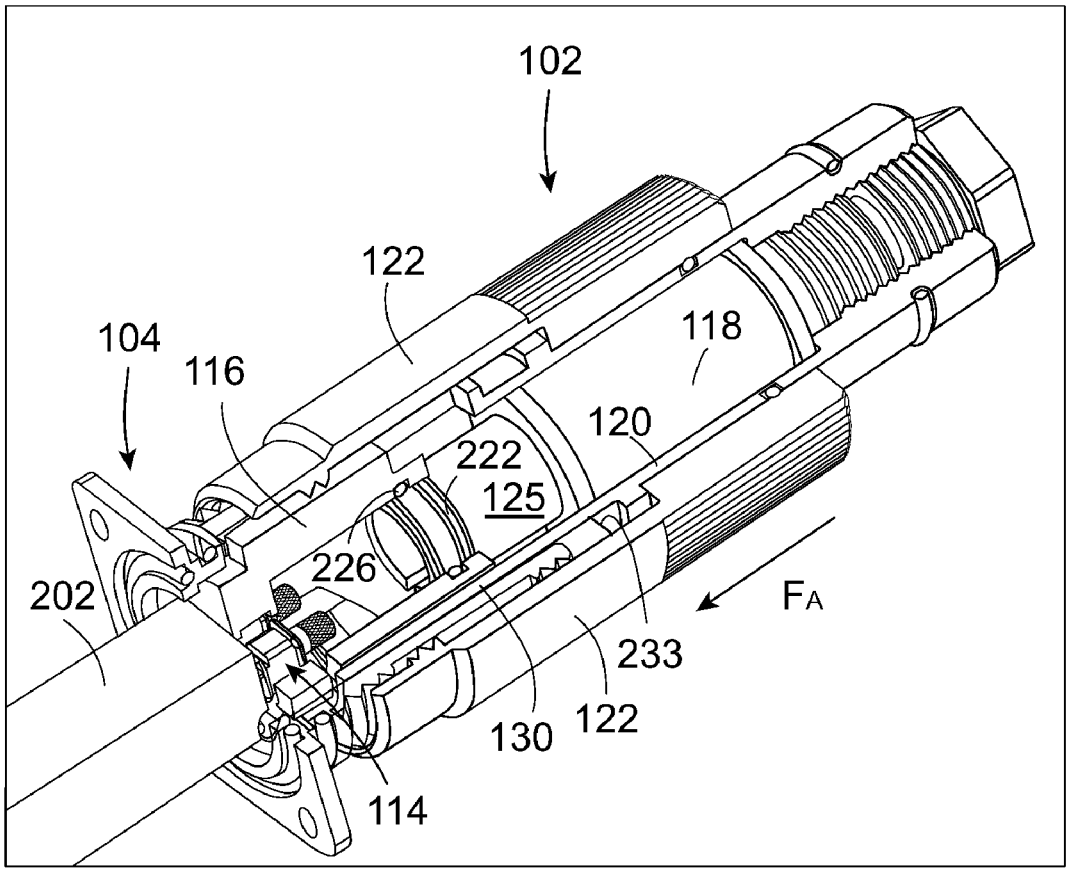
FIG. 8 is an exposed perspective view of the system in FIG. 1 when a slider element begins to move with respect to an inner body.
Figure 9:
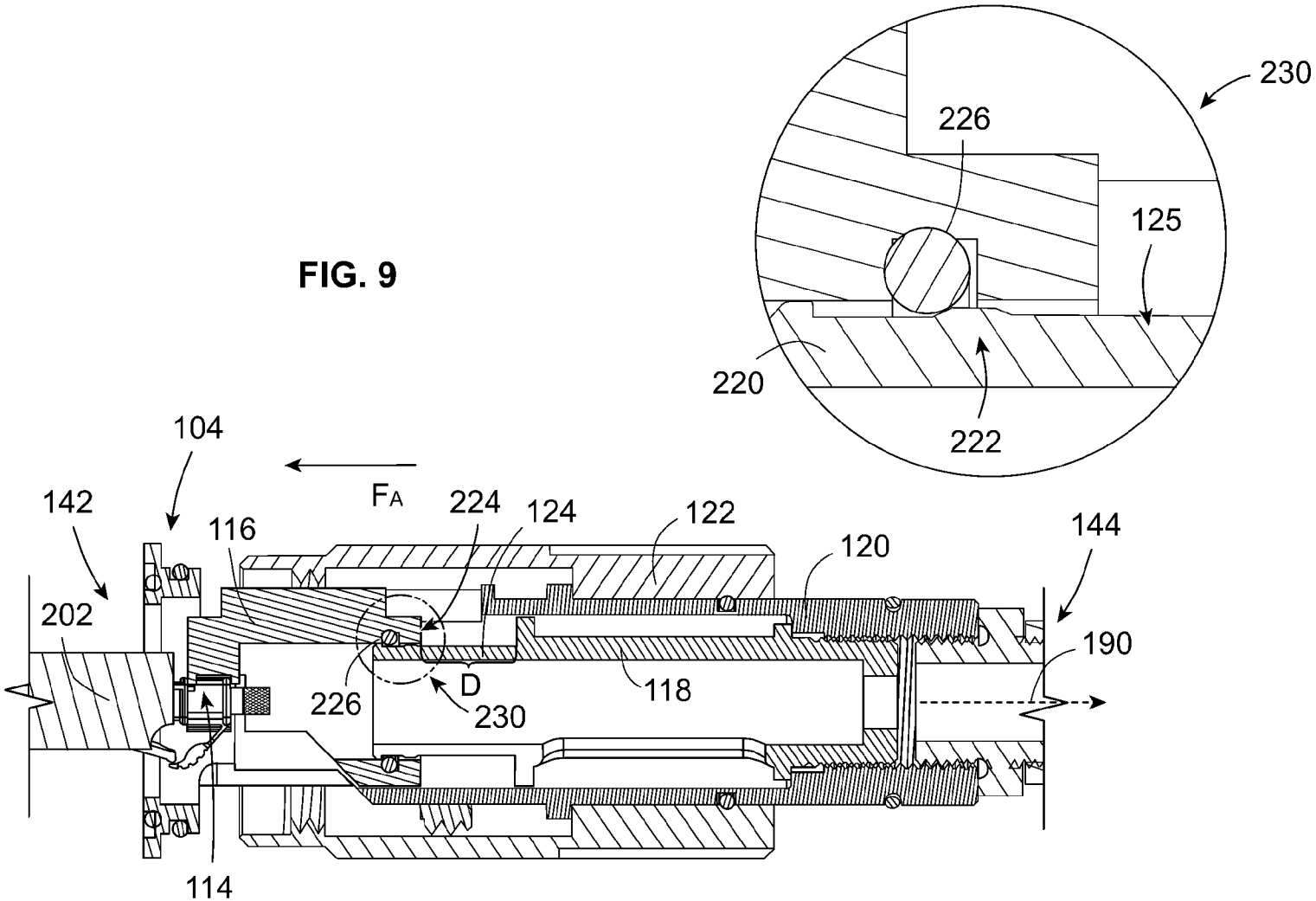
FIG. 9 is an enlarged cross-sectional view of the system shown in FIG. 8.

FIG. 8 illustrates an exposed perspective view of the connector assembly 102 and the guideframe 104 when the plug 114 engages the receiving module 202, and FIG. 9 is an enlarged cross-sectional view illustrating the holding mechanism 230. As shown in FIG. 8, the stem wall 130 moves within a gap 233 (FIG. 8) formed between the outer housing 122 and the intermediate housing 120 thereby guiding the connector assembly 102 and the plug 114 toward the receiving module 202. More specifically, the intermediate housing 120 is guided along the inside of the guideframe 104 and the outer housing 122 is guided along the outside of the guideframe 104. When the plug bodies 115 (FIG. 4) initially enter corresponding cavities (not shown) of the receiving module 202, the receiving module 202 may resist the movement of the slider element 116. Due to this resistance, if an axial force $F_A$ toward the receiving module 202 is applied the inner body 118 will then move with respect to the slider element 116 along the axial direction until the ridge 222 engages the frictional member 226 forcing the frictional member 226 to compress. When the frictional member 226 compresses against the ridge 222, the frictional member 226 and the ridge 222 cooperate in pushing the slider element 116 into the receiving module 202. The coupling mechanisms 250 (FIG. 7) of the plug bodies 115 then depress thereby allowing the plug bodies 115 to be fully inserted into the corresponding cavity of the receiving module 202. When fully inserted, the coupling mechanisms 250 snap into the engaged position (FIG. 9). The frictional member 226 may then slide over the ridge 222 and onto the body surface 125 where the inner body 118 may continue to slide if the axial force $F_A$ is applied. As such, the inner body 118, intermediate housing 120, and the outer housing 122 may continue to advance toward the guideframe 104 after the plug 114 engages the receiving module 202. The cable conductors (FIG. 2) from the cable assembly 106 (FIG. 2) may bend to account for the reducing distance between the plug 114 and the inner body 118.

As shown in FIG. 9, the ridge 222 is substantially symmetrical with respect to an axis perpendicular to the central axis 190. In an alternative embodiment, the ridge 222 is not symmetrical, but the portion of the ridge 222 closer to the cable end 144 has an incline that is shallower than an incline on the plug end 142 of the ridge 222. As such, the axial force $F_A$ necessary to overcome the ridge 222 heading in a plug-end-to-cable-end direction is greater than the axial force $F_A$ necessary to overcome the ridge in a cable-end-to-plug-end direction. Also shown in FIG. 9, the slider element 116 may move a predetermined distance D along the outer surface 125 until the slider element 116 reaches the base of the shaft 124. The position of the receiving module 202 along the central axis 190 may be different from electrical device to electrical device. Because the slider element 116 may move axially along the inner shaft 124 up to a predetermined distance D, the slider element 116 may tolerate different axial positions of the receiving modules 202. Furthermore, in some embodiments, the frictional member 226 may form a slight gap between the lip 220 (FIG. 6) and the ridge 222. If the frictional member 226 is compressible, the slider element 116 may also tolerate minor misalignments between the plug 114 and the receiving module 202.

Figure 10:
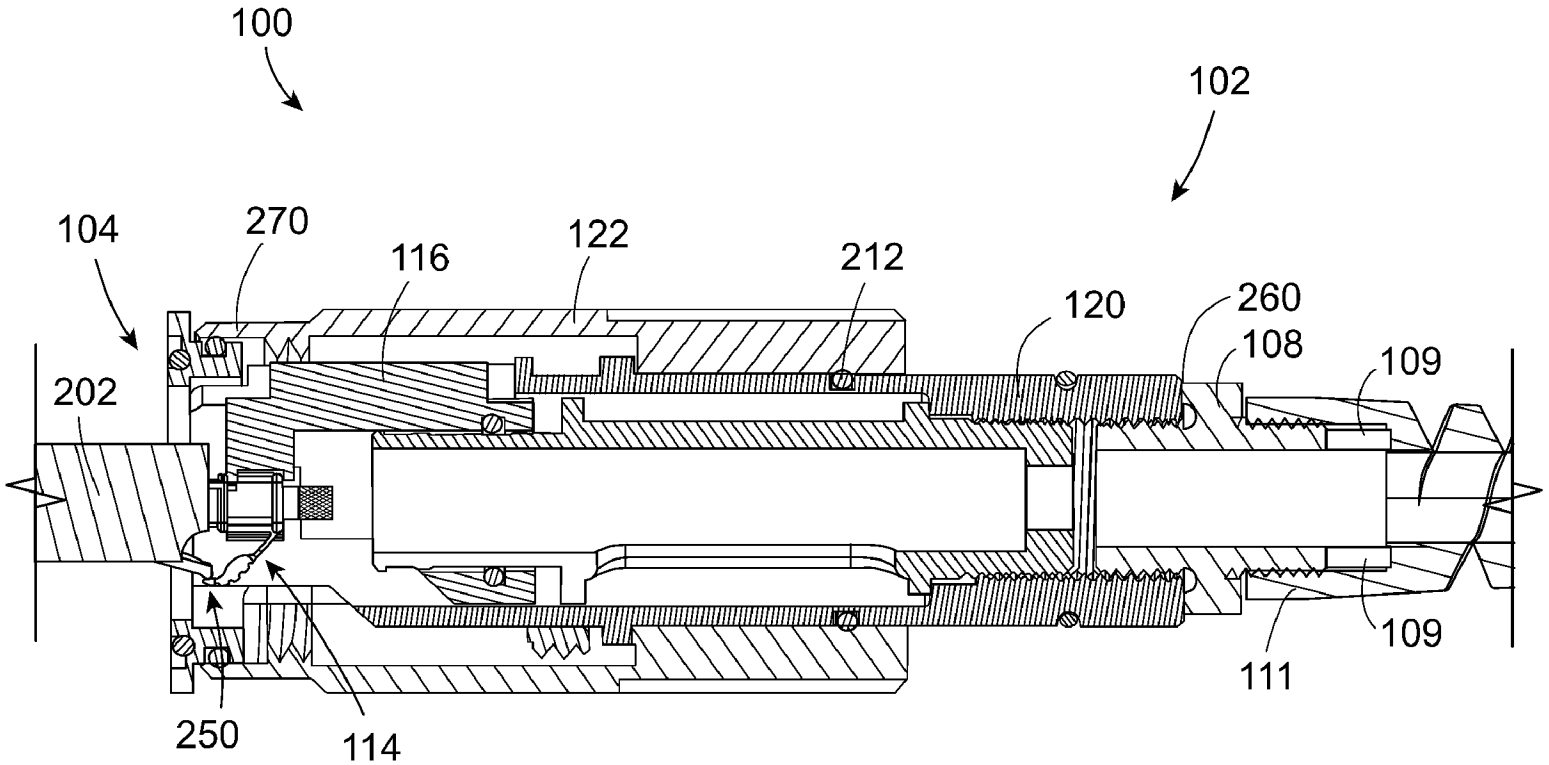
FIG. 10 is a cross-sectional view of the system shown in FIG. 1 in a fully mated position.

FIG. 10 is a cross-sectional view of the connector assembly 102 fully mated with the guideframe 104. When the connector system 100 is fully mated, the slider element 116 is in a retracted position. Due to the coupling mechanism 250, the connection between the plug 114 and the receiving module 202 is maintained without a substantial and continuous axial force into the receiving module 202. Also shown in FIG. 10, when the connector assembly 102 is fully engaged to the guideframe 104, the sealing members 260, 212, and 270 may cooperate with the outer housing 122 and the intermediate housing 120 to form an environmental seal that protects the connection from the surrounding environment. More specifically, the sealing member 270 may facilitate sealing a gap between the guideframe 104 and the outer housing 122, the sealing member 212 may facilitate sealing a gap between the intermediate housing 120 and the outer housing 122, and the sealing member 260 may facilitate sealing a gap between the intermediate housing 120 and the cable fitting 108. In addition, the cable seal gasket 109 facilitates sealing a gap between the cable fitting 108 and the cable jacket 110 (FIG. 2).

Figure 11:
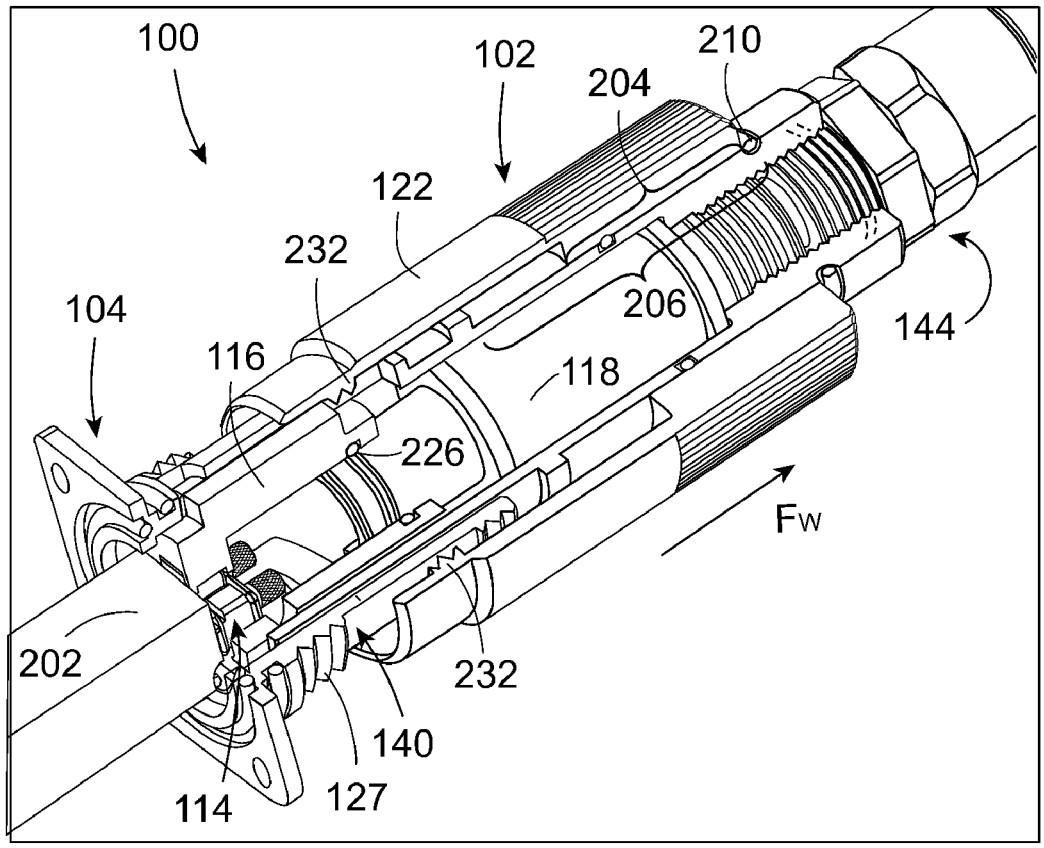
FIG. 11 is an exposed perspective view of the system shown in FIG. 1 as the connector assembly is removed from the guideframe.

FIG. 11 is an exposed perspective view of the connector system 100 as the connector assembly 102 is being withdrawn and disengaged from the guideframe 104. To disengage the fastener elements 127 and 232, the outer housing is rotated in a counter-clockwise direction. The outer housing 122 is then pulled by a retracting force $F_W$ along the outer surface 140 of the stem wall 130. Because the plug 114 is still coupled to the receiving module 202, the slider element 116 and frictional member 226 at least partially resist the retracting force $F_W$ pulling on outer housing 122. The grip portion 204 of the outer housing 122 may slide along the surface of the grip region 206 toward the cable end 144 until the outer housing 122 abuts the rear stop 210. As such, the outer housing 122 is in a withdrawn position with respect to the intermediate housing 120 and the inner body 118. As the inner body 118 slides away from the slider element 116, the slider element 116 moves toward returning to the extended position within the holding mechanism 230 (FIG. 6).

Figure 12:
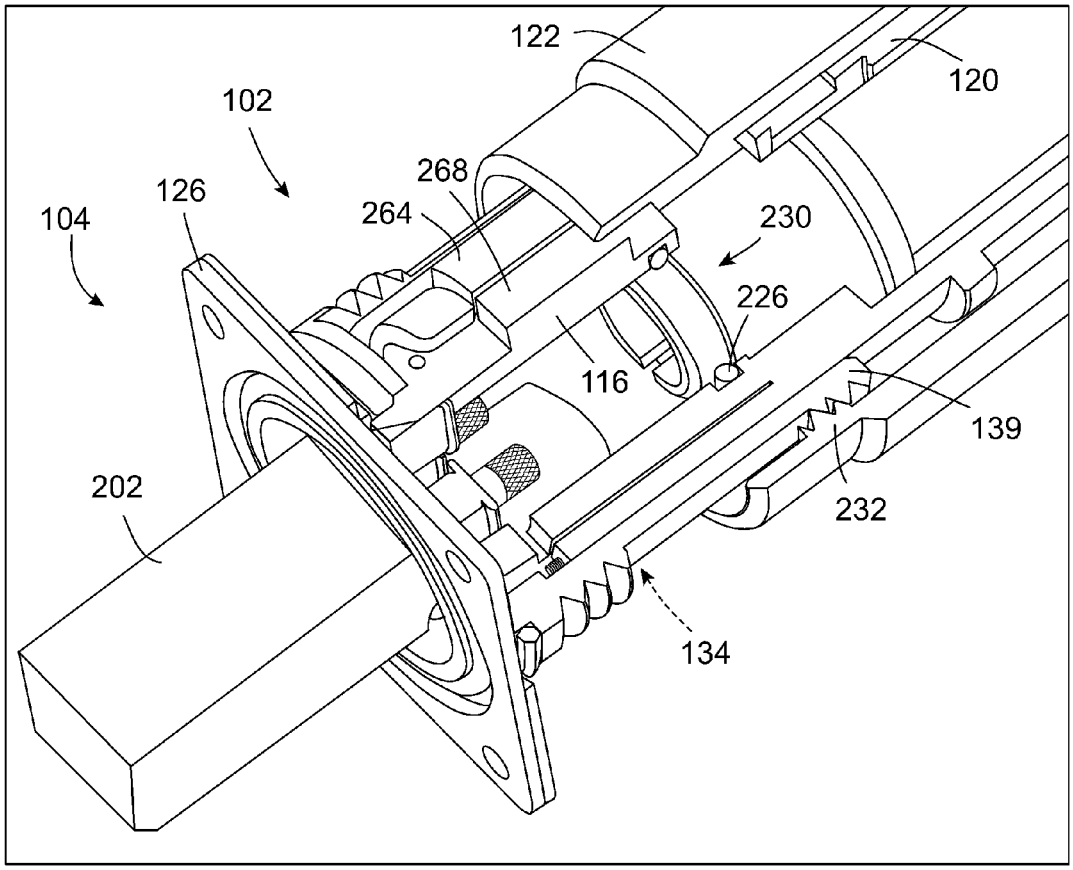
FIG. 12 is an exposed perspective view of the system shown in FIG. 1 as the connector assembly is removed from the guideframe.

FIG. 12 is a perspective view of the connector assembly 102 as the connector assembly 102 is withdrawn from the guideframe 104. As shown, the slider element 116 is in the extended position and the frictional member 226 is held within the holding mechanism 230. The fastener elements 232 and 139 are engaged such that an edge of the outer housing 122 is a distance from the panel 126 of the guideframe 104 thereby exposing the coupling mechanism 250 (FIG. 2) through the cut-out 134. In this position, a tool or finger (not shown) from a technician may depress the coupling mechanism 250 to disengage the plug 114 from the receiving module 202. Furthermore, a portion of the intermediate housing 120 and/or the slider element 116 may project out from the outer housing 122. In one embodiment, ends of key members 264 and 268 are configured to align with each other when the slider element 116 has returned to the extended position. When aligned, the key members 264 and 268 form a visual and tactile indication that the slider element 116 is in the extended position and that the coupling mechanism 250 may be triggered to disengage the plug 114 from the receiving module 202. After the coupling mechanism 250 has been triggered and the plug 114 has been released from the receiving module 202, the outer housing 122 may be further rotated to fully disengage the connector assembly 102 from the guideframe 104.

Figure 13:
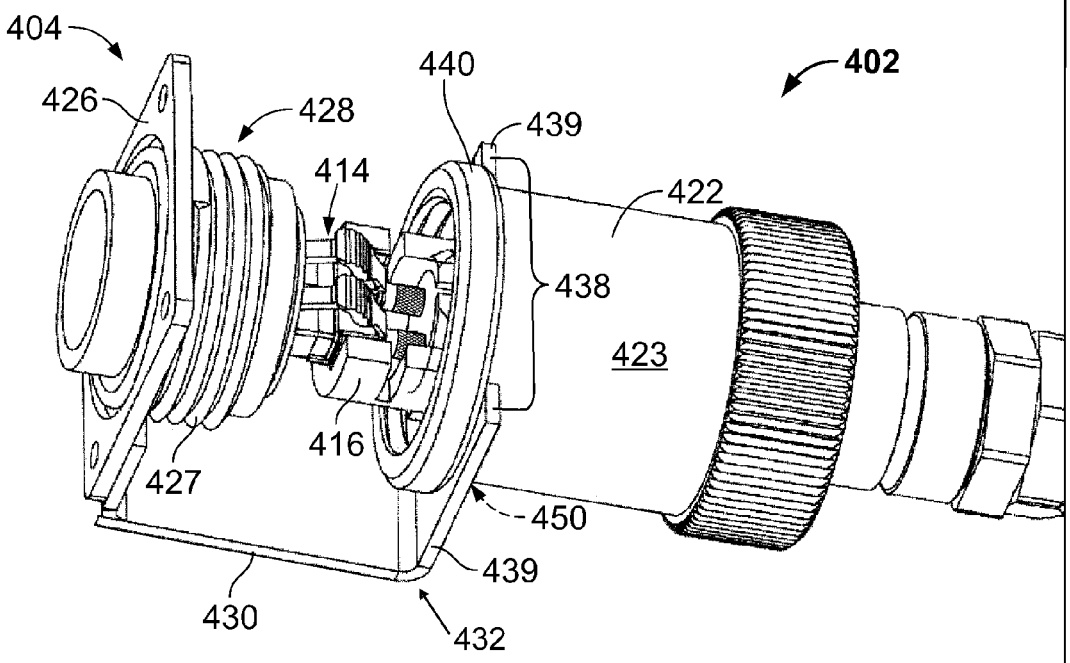
FIG. 13 is a perspective view of another guideframe that may be formed in accordance with one embodiment.

FIG. 13 is a perspective view of a guideframe 404 that may be formed in accordance with one embodiment. Similar to the guideframe 104 (FIG. 3), the guideframe 404 is used to secure a connector assembly 402 to an electrical device, such as electrical device 107 (FIG. 1). The connector assembly 402 may include similar parts and features as the connector assembly 102 described above. The guideframe 404 may include a panel 426 having an opening (not shown) and a base 428 projecting from a surface of the panel 426. The panel 426 may be secured or attached to a wall (not shown) of the electrical device 107 such that an aperture (not shown) within the wall is aligned with the opening. In an alternative embodiment, the guideframe 404 may be integratively formed with the wall of the electrical device 107. The base 428 may include a fastener element 427 extending from the base 428, which may be configured to engage an outer housing 422 of the connector assembly 402 to form a seal around a plug 414 and a receiving module, such as the receiving module 202 (FIG. 4). In FIG. 13, the fastener element 427 is one or more threads projecting from a surface of the base 428 so that corresponding threads on the outer housing 422 may engage. However, the fastener element 427 may have other means of fastening the guideframe 404 to the connector assembly 402 such as those discussed above.

The guideframe 404 may include a stem wall 430 projecting away from the panel 426 and/or the base 428. In one embodiment, the stem wall 430 initially projects radially away from the base 428, turns, and then projects axially outward from the base 428. The stem wall 430 may be secured to the panel 426 or integrally formed therewith. The stem wall 430 may also include an end portion 432 that is positioned a predetermined distance away from the base 428. The end portion 432 may have a fastener element 438, which are illustrated as a pair of fingers 439. The fingers 439 form a slot opening 450 therebetween that is configured to receive the outer housing 422. An outer surface 423 of the outer housing 422 may be pressed against the fingers 439 causing the fingers 439 to flex outward and receive the outer housing 422 within the slot opening 450. The fingers 439 loosely grip the outer surface 423 and allow the connector assembly 402 to be held or rest within the slot opening 450 while an operator is working with the electrical device 107. A rim 440 projects outwardly from the outer surface 423 and may prevent the connector assembly 402 from sliding or being pulled axially away from the guideframe 404. The predetermined distance between the fastener element 438 and the base 428 allows space for a finger or tool to engage the plug 414 (if necessary). Furthermore, the slot opening 450 may facilitate guiding the connector assembly 402 when engaging the guideframe 404. More specifically, the guideframe may facilitate guiding a slider element 416 holding the plug 414 into the corresponding receiving module 202.

It is to be understood that the above description is intended to be illustrative, and not restrictive. As such, the above-described embodiments (and/or aspects thereof) may be used in combination with each other. In addition, many modifications may be made to adapt a particular situation or material to the teachings of the invention without departing from its scope. For example, the inner body 118 (FIG. 2) and the intermediate housing 120 (FIG. 2) may be integratively formed. Furthermore, the guideframe 104 (FIG. 3) may have only one fastening element or more than two fastening elements.

Dimensions, types of materials, orientations of the various components, and the number and positions of the various components described herein are intended to define parameters of certain embodiments, and are by no means limiting and are merely exemplary embodiments. For example, although the inner body 118, intermediate housing 120, and outer housing 122 (FIG. 2) have cylindrical shapes in the Figures, other shapes may be used provided that the slider element 116 may move/slide along an outer surface of the inner body 118. Furthermore, the outer housing 122 may directly couple to the inner body 118 if the intermediate housing 120 is not used. Many other embodiments and modifications within the spirit and scope of the claims will be apparent to those of skill in the art upon reviewing the above description. For example, the guideframe 104 may be configured such that the outer housing 122 is inserted into the pathway 132 (FIG. 3) and an outer surface of the outer housing 122 may engage threads or other fastening elements within the guideframe 104. Furthermore, it is not necessary for the inner body 118 to have a shaft for holding the slider element 116; rather, the slider element 116 may directly engage the inner body 118.

The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. A connector assembly having a plug end and a cable end, the connector assembly configured to insert a plug coupled to a cable into a receiving module of an electrical device, the connector assembly comprising:

an inner body having a cable channel extending in an axial direction between the plug end and the cable end;

a slider element configured to attach to and hold the plug proximate to the plug end, the slider element being held by and movable along the inner body in an axial direction, the slider element moving with the plug; and an outer housing surrounding at least a portion of the inner body and the slider element.

2. The connector assembly in accordance with claim 1 wherein the inner body further comprises a body surface and the slider element comprises a slider body, the connector assembly further comprising a frictional member located between the body surface and the slider body, the frictional member resisting movement of the slider element as the slider element moves in the axial direction.

3. The connector assembly in accordance with claim 2 wherein the inner body further comprises a lip and a ridge projecting from the body surface and separated by a predetermined distance, the frictional member configured to rest between the lip and the ridge when the slider element is in an extended position on the body surface.

4. The connector assembly in accordance with claim 2 wherein the slider element includes the frictional member, the frictional member being compressible such that the slider element is configured to tolerate minor misalignments between the plug and the receiving module.

5. The connector assembly in accordance with claim 1 wherein the slider element slides along an outer surface of the inner body.

6. The connector assembly in accordance with claim 1 wherein the outer housing is movable in the axial direction with respect to the inner body and the slider element when the plug is coupled to the receiving module.

7. The connector assembly in accordance with claim 1 wherein the outer housing is rotatable around a central axis extending between the plug end and the cable end.

8. The connector assembly in accordance with claim 1 wherein the slider element is movable between different axial positions along the inner body while the plug is coupled to the receiving module.

9. The connector assembly in accordance with claim 8 wherein the slider element is in an extended position when the plug initially engages and couples to the receiving module, the slider element moving closer to the cable end when the inner body is moved toward the receiving module.

10. The connector assembly in accordance with claim 1 wherein the slider element is movable bi-directionally between different axial positions along the inner body so that the plug moves to and from an end of the inner body between the receiving module and the end of the inner body.

11. The connector assembly in accordance with claim 1 wherein the slider element does not maintain a substantial and continuous axial force toward the receiving module when the plug is coupled to the receiving module.

12. A connector system having a plug end and a cable end, the connector system configured to insert a plug coupled to a cable into a receiving module of an electrical device, the connector system comprising:

a guideframe having a base positioned proximate to the receiving module; and a connector assembly configured to engage the guideframe, the connector assembly comprising;

an inner body having a cable channel extending in an axial direction between the plug end and the cable end;

a slider element configured to attach to and hold the plug proximate to the plug end, wherein the slider element is held by and movable along the inner body in an axial direction, the slider element moving with the plug; and an outer housing surrounding at least a portion of the inner body and the slider element.

13. The connector system in accordance with claim 12 wherein the outer housing is movable in the axial direction with respect to the inner body and the slider element.

14. The connector system in accordance with claim 12 wherein the guideframe is positioned between the inner body and the outer housing when the plug is engaged with the receiving module.

15. The connector system in accordance with claim 12 wherein the guideframe includes a stem wall extending from the base for guiding the connector assembly to the receiving module, the stem wall including a first fastener element located proximate to the base and a second fastener element located on the stem wall a predetermined distance apart from the first fastener element.

16. The connector system in accordance with claim 12 wherein the guideframe includes a stem wall extending from the base for guiding the connector assembly to the receiving module, the stem wall defining a pathway to the receiving module and having a cut-out therethrough that provides access to the pathway, and wherein the inner body includes a body surface and a key member projecting from the body surface, the key member configured to slide into the cut-out when the inner body is advanced into the guideframe.

17. A connector assembly having a plug end and a cable end, the connector assembly configured to insert a plug coupled to a cable conductor into a receiving module of an electrical device, the connector assembly comprising:

an inner body having a cable channel extending in an axial direction between the plug end and the cable end; and a slider element attached to and holding the plug proximate to the plug end, the slider element being held by and movable along the inner body in an axial direction, the slider element moving with the plug.

18. The connector assembly in accordance with claim 17 further comprising the plug and the cable conductor, the plug comprising a coupling mechanism configured to removably attach the plug to the receiving module, the coupling mechanism configured to be triggered to release the plug from the receiving module.

19. The connector assembly in accordance with claim 17 further comprising the plug and the cable conductor, the cable conductor bending within the cable channel when the plug is moved in the axial direction.

20. The connector assembly in accordance with claim 17 further comprising an outer housing surrounding at least a portion of the inner body and the slider element.

* * * * *